US010080399B2

(12) United States Patent
Ozburn

(10) Patent No.: US 10,080,399 B2
(45) Date of Patent: Sep. 25, 2018

(54) BUCKLE LOCKET

(71) Applicant: Wendy Jeanne Ozburn, Firebaugh, CA (US)

(72) Inventor: Wendy Jeanne Ozburn, Firebaugh, CA (US)

( * ) Notice: Subject to any disclaimer, the term of this patent is extended or adjusted under 35 U.S.C. 154(b) by 81 days.

(21) Appl. No.: 14/998,884

(22) Filed: Feb. 25, 2016

(65) Prior Publication Data

US 2017/0245600 A1 Aug. 31, 2017

(51) Int. Cl.

| | |
|---|---|
| ***A44B 11/00*** | (2006.01) |
| ***A44C 25/00*** | (2006.01) |
| *A41F 9/00* | (2006.01) |
| *A44C 17/02* | (2006.01) |

(52) U.S. Cl.

CPC ..... *A44B 11/001* (2013.01); *A44C 25/004* (2013.01); *A41F 9/002* (2013.01); *A44C 17/0225* (2013.01)

(58) Field of Classification Search

CPC ... A44B 11/001; A44B 11/005; A44B 25/002; A44B 25/004; Y10T 24/4098

USPC ..... 24/163 K

See application file for complete search history.

(56) References Cited

U.S. PATENT DOCUMENTS

| | | | | |
|---|---|---|---|---|
| 749,995 | A * | 1/1904 | Johnson | A44B 11/24 224/163 |
| 4,570,308 | A * | 2/1986 | Weisgerber | A44B 11/005 224/163 |
| 6,182,388 | B1 * | 2/2001 | Patton | A44B 11/001 24/163 K |
| 6,920,672 | B1 * | 7/2005 | Hubbard | A44B 11/001 24/163 K |
| 7,784,655 | B2 * | 8/2010 | Su | A44B 11/005 224/163 |
| 8,387,412 | B2 * | 3/2013 | O'Byrne | A44C 5/0007 24/303 |
| 9,113,677 | B2 * | 8/2015 | Anderson | A44B 11/001 |
| 9,398,792 | B2 * | 7/2016 | Liao | A44C 25/00 |
| 2007/0234757 | A1 * | 10/2007 | Sherman | A44C 25/002 63/18 |
| 2015/0173471 | A1 * | 6/2015 | Weems | A44C 25/004 63/19 |
| 2017/0099916 | A1 * | 4/2017 | Burr | A44C 25/004 |

* cited by examiner

*Primary Examiner* — Joshua T Kennedy

(57) ABSTRACT

A buckle locket. The invention is configured to be worn with a strap consisting of hardware specific to securing the D-ring of the buckle locket case. The buckle locket is held onto the wearer with a strap consisting of holes to allow the tongue of the buckle locket to hook onto the strap. The invention includes a case and a frame. The case and the frame can be interchanged. The invention includes an interchangeable design holster that holds up to three sixteenths of an inch of materials. The design holster is magnetically held in place inside the case of the buckle locket. The frame, containing the industrial strength window of the buckle locket, magnetically attaches to the case. The windowed frame protects the integrity of the interior design holster and the safety of the wearer. The invention is worn conventionally and as a mobile display.

4 Claims, 8 Drawing Sheets

BUCKLE LOCKET

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF INVENTION

1. Field of the Invention

This invention is in the technical field of buckles, and more specifically relates to buckles as windowed lockets having interchangeable faceplate frames and interchangeable interior design holster inserts.

2. Description of the Related Art

There are many known utilitarian decorative buckle devices. Most of these buckle devices are of various shapes, sizes, color, and materials that are devised as one piece, stamped out, one dimensional, and stationary decorative design facings or a two-part system that is constructed with a magnetic backing feature providing interchangeable, one-dimensional, decorative design faceplates.

Known one and two-part buckle devices have design parameters that limit buckle shapes, sizes, colors, and materials hindering the full scope of the buckle device application and poses a greater expense to the user wanting to obtain diversified expression. To protect the colors and materials of the buckle design, the prior related art also warrants little or no protection with the possible usage of acrylic Plexiglas, enamels, and resin sealants.

SUMMARY OF THE INVENTION

The present invention is a three-part buckle locket consisting of a case, frame, and design holster. The buckle locket case, frame, and holster are not limited to shape, size, or color. All parts deem a bottom and a top.

The bottom of the buckle case is ergonomically contoured and is equipped with traditional buckle hardware of one tongue and two forks. The forks hold a separate attachable loop or D-ring. The buckle hardware works best with a traditional snap button belt or strap, however does not limit the kind of securing device used with the buckle locket. The top of the buckle case is constructed with a shallow magnetic housing with elevated side walls that magnetically adhere to the responsive magnetic field located on the bottom of the frame.

The frame is interchangeable and compatible with the buckle case. The top frame is a decorative component providing the option of colored enamels, crystals, semi-precious stones, natural stones, and other various mediums and textures. The frame encases an industrial-strength sheeted glass window that protects and displays the design holster and its housed materials.

The design holster is interchangeable and compatible with the buckle case and frame. The design holster is stainless steel and magnetically adheres to the floor of the buckle case magnetic housing. The design holster houses an array of one to three-dimensional design notions including but not limited to 3D-printed paper and mediums, fabric, suede, wood veneer, ceramics, glass, embroidery, natural and artificial embellishments, crystals, glitter, and ink.

This invention provides the user the ability to not only use their buckle device conventionally, but gives them the liberty to use their buckle as interchangeable decorative and expressive statements, memorials, trophies, collector pieces, and as commemoratives which are not limited to the individual's expressive prerogatives.

REFERENCE NUMERALS IN THE DRAWINGS

| | |
|---|---|
| 18 buckle locket assembled | 20 case top |
| 22 case housing | 24 insert |
| 26 design holster bottom | 28 interchangeable design holster |
| 30 magnet housing | 32 magnet(s) |
| 34 case bottom | 36 forks(s) |
| 38 loop hole | 40 tongue |
| 42 tongue platform | 44 frame hook |
| 46 case eye | 48 frame bottom |
| 50 industrial glass | 52 side groove |
| 54 frame top | 56 shelf |

DETAILED DESCRIPTION OF THE INVENTION

FIGS. 01-15 shows the claimed buckle locket assembly.

Figure 1:
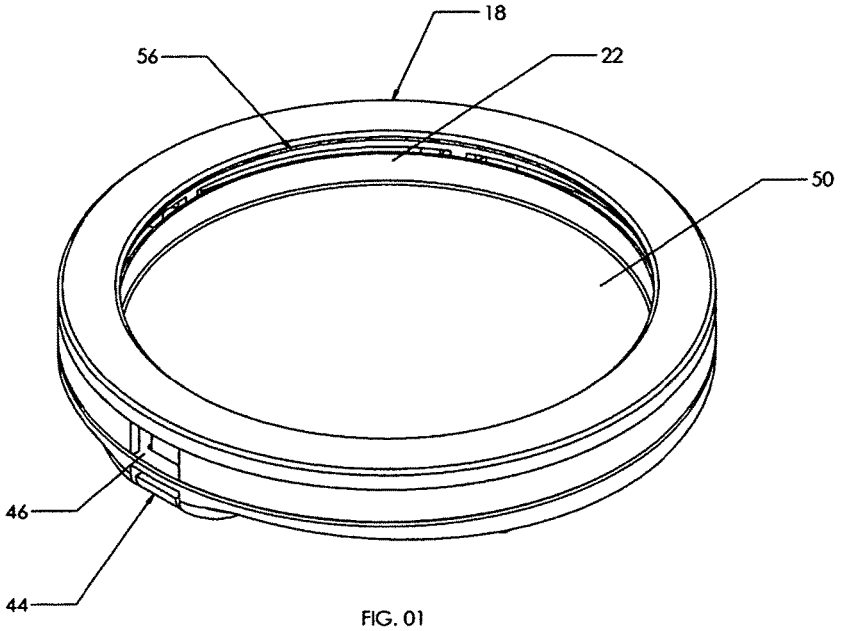
FIG. 01 is an isometric view of the buckle locket assembled with the design holster.

FIG. 01 shows an isometric view of the buckle locket assembled 18 with the interchangeable design holster 28. The design holster is magnetically attached to the insert 24 of the case housing 22. The insert 24 is bonded to the back wall of the case housing 22. The insert 24 material is a magnetic sheeting which provides a low magnetic pull to the responsive magnetic stainless steel design holster 26. The buckle locket is equipped with a protective industrial glass 50 covering encased on the shelf 56 of the frame bottom 48. The buckle locket case top 20 and frame bottom 48 are magnetically fastened together with commercial grade magnet(s) 32 for the buckle locket to securely close. The magnetic pull is determined by the number of magnet(s) 32 based on the given shape and size of the buckle locket model. To assist with opening the buckle locket, there is a side groove 52 adjacent to the frame hook 44 and the case eye 46.

Figure 2:
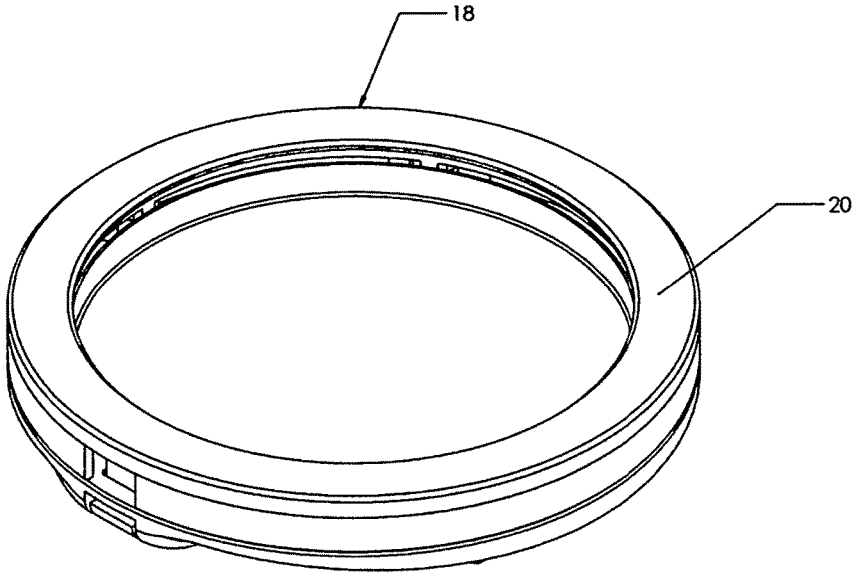
FIG. 02 is an isometric view of the buckle locket assembled without the design holster.

FIG. 02 shows an isometric view of the buckle locket assembled 18 without the interchangeable design holster 28. The buckle locket case and frame are made of primarily a zinc based alloy and are not limited to material, shape, size, or color.

Figure 3:
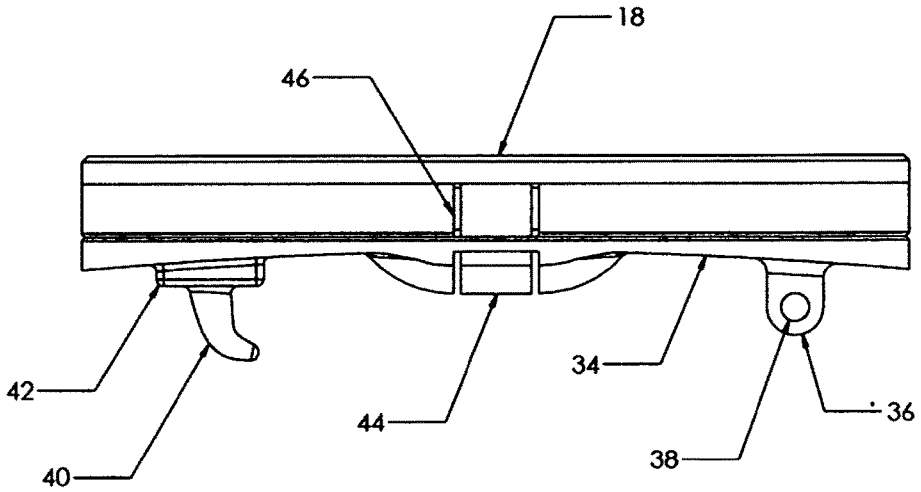
FIG. 03 is a perspective view of the front of the buckle locket assembled.

FIG. 03 shows a perspective front view of the buckle locket assembled 18. The case bottom 34 has a tongue 40 that is mounted into the tongue platform 42 for added support. The tongue 40 is positioned at a forty-five degree angle to aid in securing the buckle into a hole of a snap-button belt or strap. The case bottom 34 has fork(s) 36 with a loop hole 38 designed to be used in conjunction with either a traditional buckle loop or D-ring. The buckle locket assembled 18 shows the frame hook 44 and case eye 46 linked together.

Figure 4:
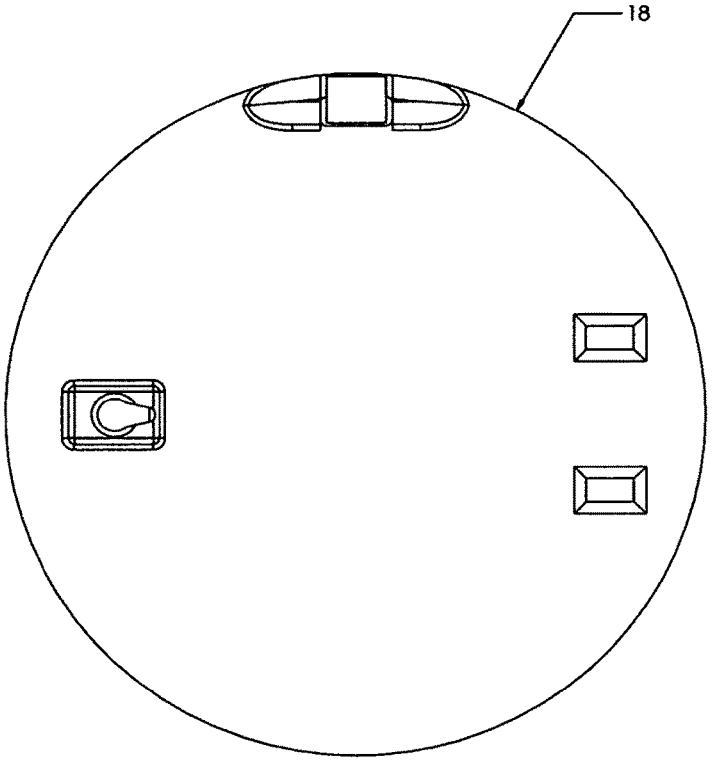
FIG. 04 is a perspective view of the bottom of the buckle locket assembled.
Figure 5:
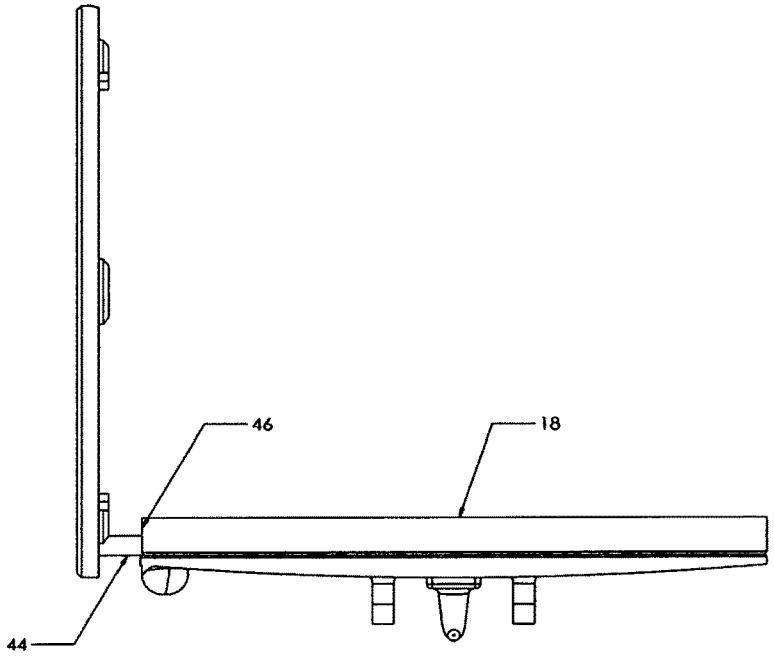
FIG. 05 is a perspective view of the right of the buckle locket assembled and open.
Figure 6:
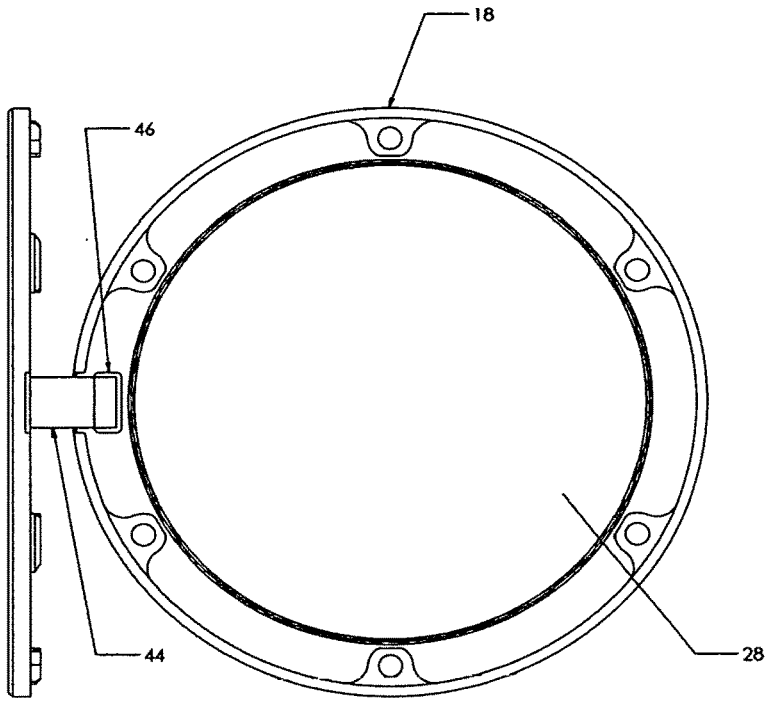
FIG. 06 is a perspective view of the top of the buckle locket opened with the design holster.
Figure 7:
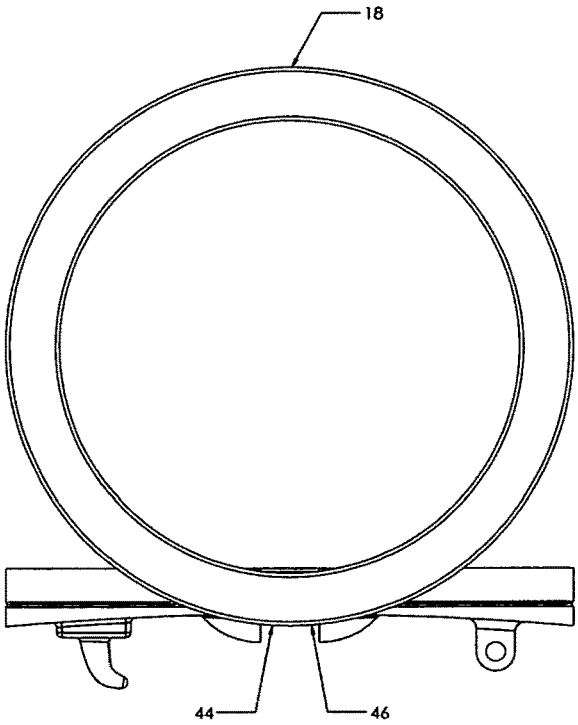
FIG. 07 is a perspective view of the front of the buckle locket assembled and opened.
Figure 8:
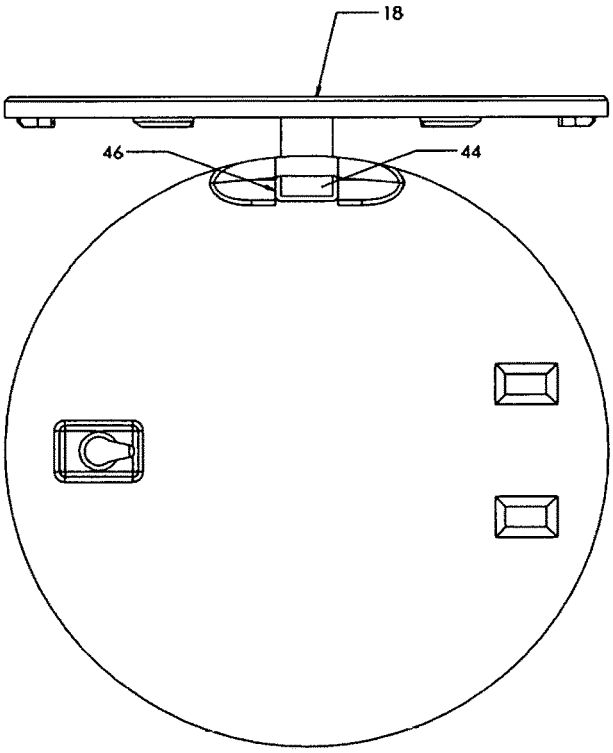
FIG. 08 is a perspective view of the bottom of the buckle locket assembled and opened.

FIG. 04 shows a perspective bottom view of the buckle locket assembled 18.

FIGS. 05-08 shows perspective views of the buckle assembled 18 and open with the frame hook 44 latched to the case eye 46.

Figure 9:
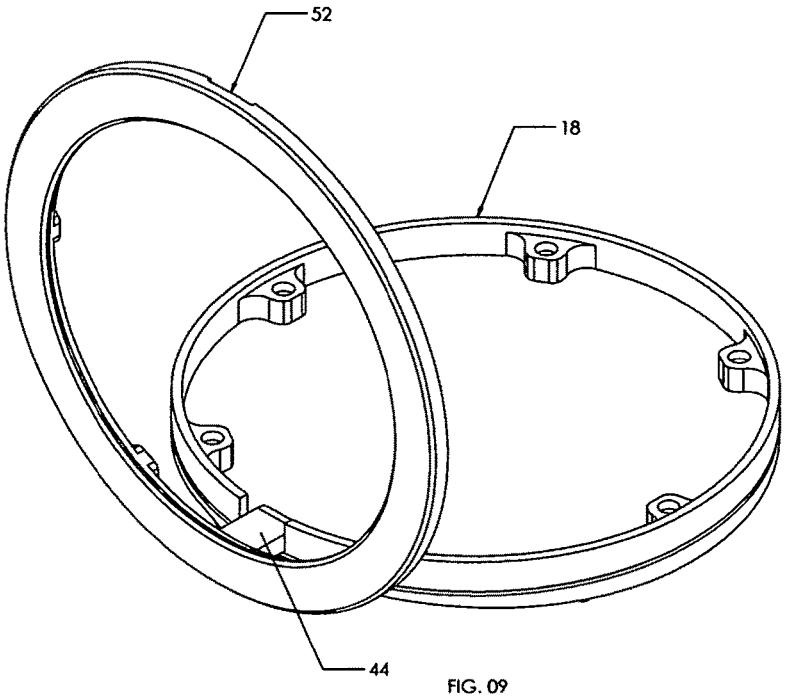
FIG. 09 is an isometric view of the buckle locket assembled, opened, and with the design holster.
Figure 10:
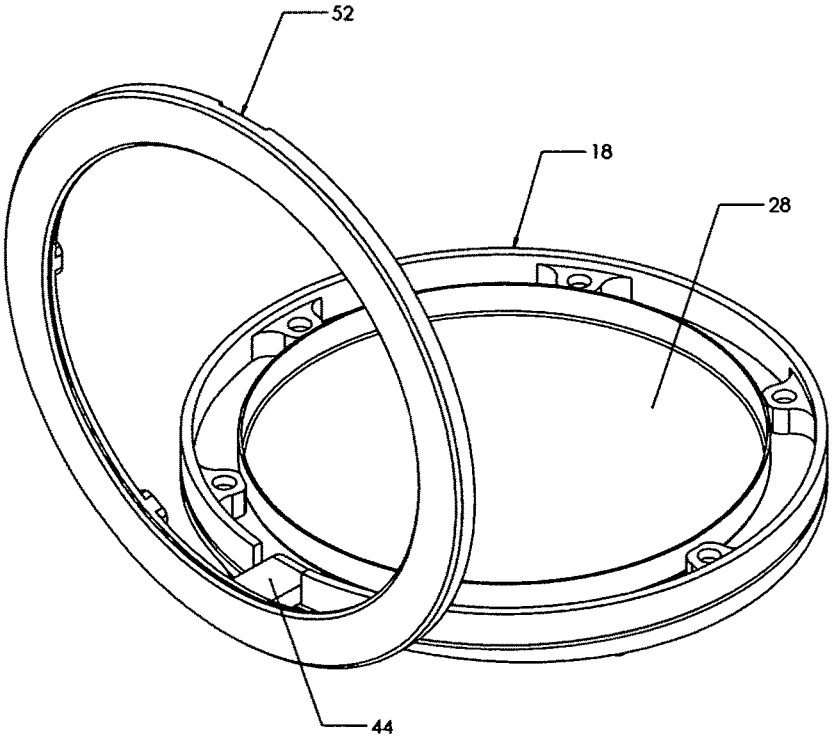
FIG. 10 is an isometric view of the buckle locket assembled, opened, and without the design holster.

FIGS. 09-10 shows isometric views of the buckle assembled 18 and open with the frame hook 44 latched to the case eye 46 with and without the interchangeable design holster 28.

Figure 11:
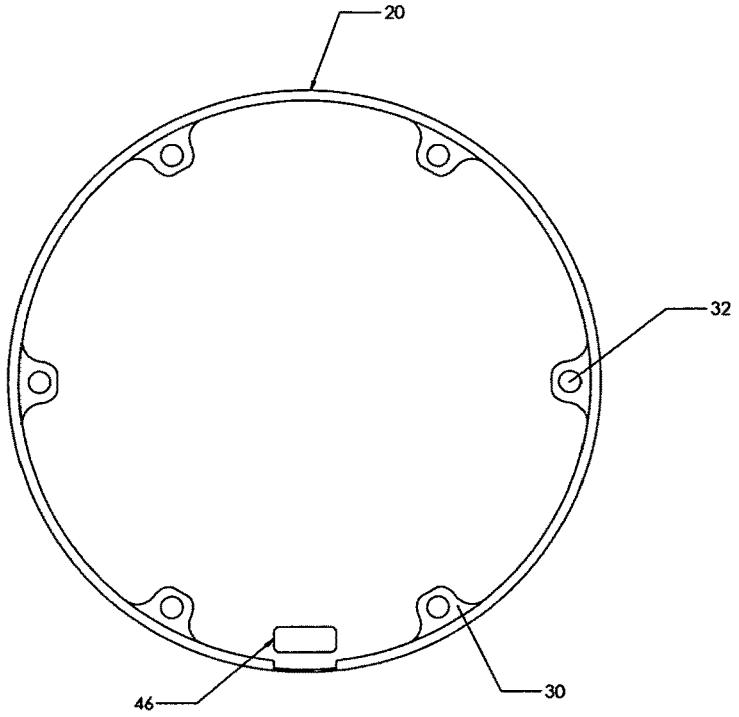
FIG. 11 is a perspective view of the top of the buckle locket case.

FIG. 11 shows a perspective view of the case top 20 case housing 22. The case housing 22 contains the insert 24, the interchangeable design holster 28, magnet housing 30, and the magnet(s) 32. In which has the case eye 46 as an opening for the frame hook 44.

Figure 12:
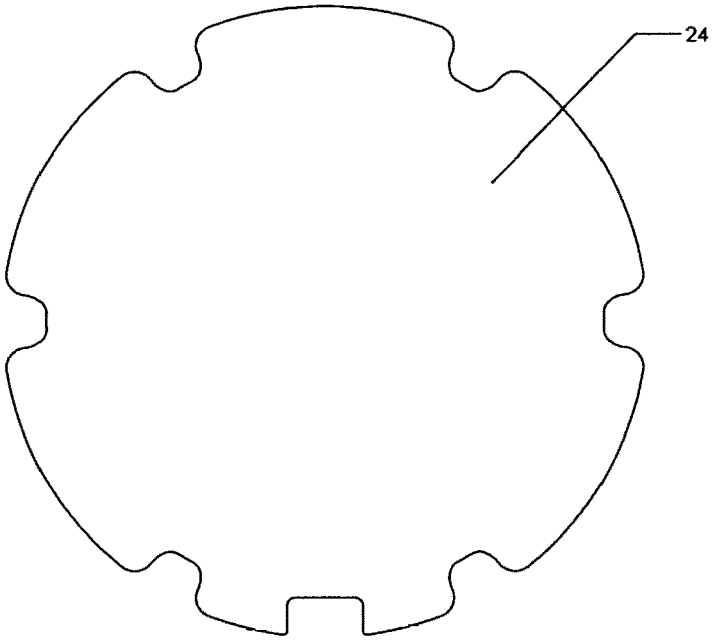
FIG. 12 is a perspective view of the top of the buckle case magnetic backing.

FIG. 12 shows a perspective view of the insert 24 sized to fit the buckle model. The insert 24 material is a magnetic sheeting which provides a low magnetic pull to the responsive magnetic stainless steel design holster.

Figure 13:
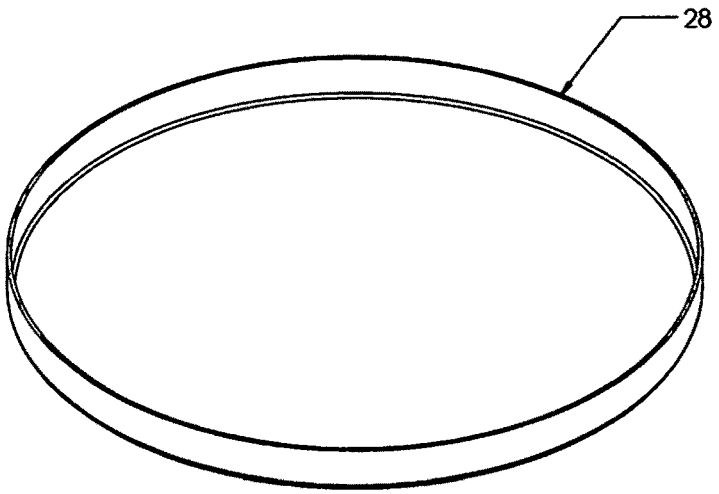
FIG. 13 is an isometric view of the design holster.

FIG. 13 shows an isometric view of the interchangeable design holster 28. The interchangeable design holster 28 is made of stainless steel in which is magnetically responsive to the magnetic sheeting insert 24. The design holster 26 houses an array of one and three-dimensional design notions including but not limited to 3D-printed paper and mediums, fabric, suede, wood veneer, ceramics, glass, embroidery, natural and artificial embellishments, crystals, glitter, and ink.

Figure 14:
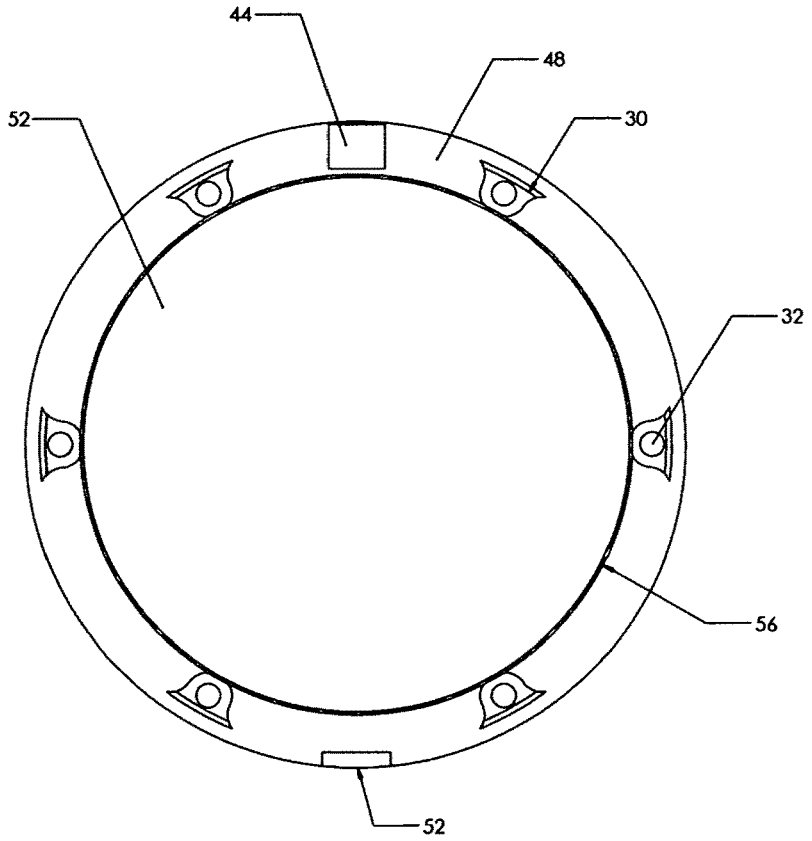
FIG. 14 is a perspective view of the bottom locket frame.
Figure 15:
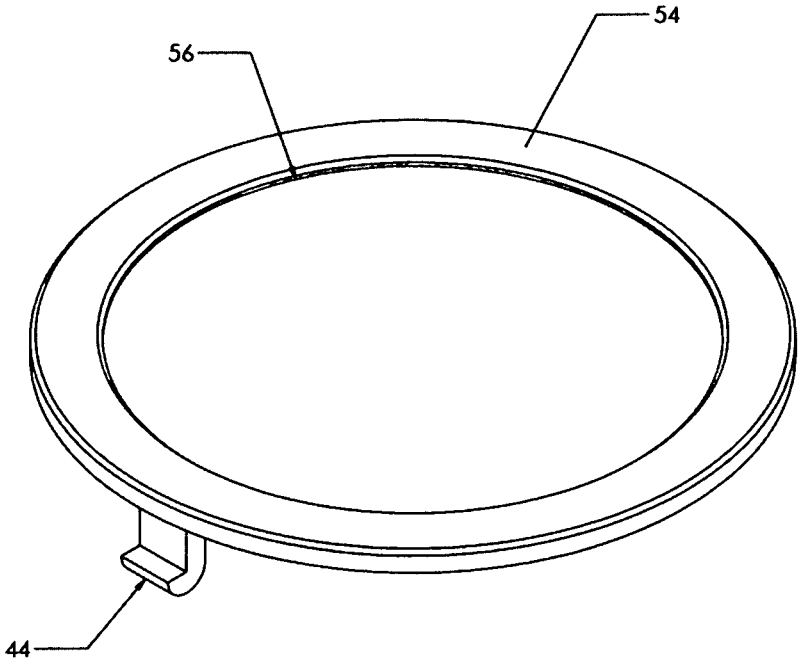
FIG. 15 is an isometric view of the top of the buckle locket frame.

FIGS. 14-15 shows perspective views of the frame bottom 48 and of the frame top 54 in which has the frame hook 44 as a latch for the case eye 46. There is a shelf 56 built into the inner diameter of the frame bottom 48. The shelf 56 holds the industrial glass 50 which is bonded to the shelf 56 edges. The frame bottom 48 has a magnet housing 30 and magnet(s) 32. Magnet(s) 32 are secured into the magnet housing 30 with an industrial adhesive and are set flush to the parent metal. The number of magnet(s) 32 used are subject to how many pounds of magnetic pull is necessary based on the shape and size of the buckle locket model to securely close. The buckle locket frame top 54 is interchangeable and compatible with the buckle locket case. The frame top 54 can consist of having no design or can consist of various design features, textures, and mediums not limited to shape, size, or color.

Having described my invention, I claim:

1. A buckle locket configured for attachment to a belt, comprising:

a a case of solid material having a top surface and a bottom surface comprising:
  a magnetic housing defining side walls extending from said top surface;
  a pair of forks extending from said bottom surface configured for the attachment to a belt; and
  a tongue extending from said bottom surface and spaced from said forks configured for the attachment to a belt;

a frame of solid material having a solid transparent paneled material encased therein; said frame being hingedly connected to said case and having a magnetic portion to releasably connect to said top surface of said magnetic housing in a closed configuration; and a holster magnetically attached to a floor of said magnetic housing within said case and defining an interior space configured for housing an attachable material.

2. A buckle locket as claimed in claim 1, wherein the side walls of said magnetic housing comprises a prearranged number of housings.

3. A buckle locket as claimed in claim 2, wherein a prearranged number of magnets are paired with their respective housings.

4. A buckle locket as claimed in claim 1, further comprising a loop hole located at the upper end of the forks configured to support an attachable D-ring.

* * * * *